United States Patent [19]

Gaves

[11] Patent Number: 4,890,761

[45] Date of Patent: Jan. 2, 1990

[54] RESEALABLE POUCH/BOX COMBINATION

[75] Inventor: James W. Gaves, Chateauguay, Canada

[73] Assignee: Rolf C. Hagen Inc., Montreal, Canada

[21] Appl. No.: 204,116

[22] Filed: Jun. 8, 1988

[51] Int. Cl.[4] ..... B65D 5/54; B65D 5/56

[52] U.S. Cl. ..... 220/404; 206/625; 220/410; 220/416; 220/462; 220/463

[58] Field of Search ..... 220/461–463, 220/404, 408, 410, 416; 206/621, 625

[56] References Cited

U.S. PATENT DOCUMENTS

| | | | |
|---|---|---|---|
| 2,170,378 | 8/1939 | Orstrom | 220/463 |
| 2,292,653 | 8/1942 | Palmer | 220/463 |
| 2,933,229 | 4/1960 | Bensel | 220/462 |
| 4,266,668 | 5/1981 | Paek | 220/404 |
| 4,676,394 | 6/1987 | Hiersteiner | 220/410 |
| 4,679,701 | 7/1987 | Ackermann et al. | 220/463 |

FOREIGN PATENT DOCUMENTS

| | | | |
|---|---|---|---|
| 1541120 | 8/1968 | France | 220/461 |

*Primary Examiner*—Gary Elkins

*Attorney, Agent, or Firm*—Wolf Greenfield & Sacks

[57] ABSTRACT

A package particularly intended for use with a flowable material. The package includes an outer semi-rigid box made of cardboard or the like and a flexible bag-like pouch within the box. An opening defined by a removable tab is provided in the box and extends from the top wall into a side wall thereof, and a slot is provided in the side wall which extends to the margin of the opening. To open the package, the tab is removed so as to expose the pouch, and a corner of the pouch may be pulled through the opening at the top and be torn or cut from it. In this manner, the contents may be poured from the pouch. To reseal the pouch, the margin of the opening cut or torn from it is pulled into the slot.

14 Claims, 3 Drawing Sheets

RESEALABLE POUCH/BOX COMBINATION

INTRODUCTION

This invention relates to packaging and more particularly to packaging for dry, flowable material such as feed and seed for pets and home aquarium fish as well as for a variety of foodstuffs for human consumption.

At the present time, a great variety of materials are sold in packages that include an outer box made of cardboard, corrugated or the like, and an inner sealed liner or pouch which maintains the freshness of the material. Typically, packages of that type are opened by pulling apart the flaps of the cover of the box and tearing opening the top of the pouch. To reclose the package, the open end of the pouch is rolled up or twisted and the flaps of the package are closed by a tongue and slot provided in the flaps. Frequently, the tongue and the slot are torn when the package is initially opened and therefore, there is no convenient means for securely reclosing the package.

The principal object of the present invention is to provide a very simple package having an effective means for reclosing the package and which does not significantly add to the manufacturing cost of the package.

Another important object of this invention is to provide a closure system for disposable packages which is both effective and convenient for the user.

A more specific object of the present invention is to provide a closure means for packages which essentially clamps the package liner closed so that its contents may not be accidently spilled.

To accomplish these and other objects, the package of the present invention includes a box and inner liner or pouch, which in many aspects are identical to packaging widely used today. The box, however, is provided with a pull off tab, a portion of which is formed in the top wall of the box and another portion in its side wall. The lower end of the tab in the side wall is generally V-shaped, and it terminates in a slot also cut in the box and which extends a short distance down the side wall from the tab. The tab is merely pulled from the box along the top and side walls to form a permanent opening in the box. The opening is sufficiently large to enable the top edge or corner of the pouch to be pulled out of the box so that it may be torn or cut to open the pouch. With the package open in that fashion, its contents may be poured from the package. To reclose and reseal the package, the user merely grasps the exposed margins of the opening in the pouch through the opening in the package defined by the removed tab, and pulls the margins downwardly into the slot. The V-shaped portion of the opening in the box guides the margins into the slot, and the box in the region of the slot is of sufficiently rigid material so as to form an effective clamp on the pouch material and maintain it in a closed and sealed condition. To pour additional material from the package, the exposed margin of the pouch which extends through the slot is slipped from it so that the opening in the pouch is aligned with the opening in the box. In this position, additional amounts of the packaged material may be removed.

In accordance with a second embodiment of this invention, an additional slot is provided in the top wall, extending from the margin of the opening away from the side in which the first slot is formed. The second slot is used when the contents of the pouch is to be poured from the package. By slipping the top margin of the pouch beyond the pouch opening into the second slot, the pouch is supported in an erect position within the box, and its opening is held in alignment with the box opening so that the contents can be conveniently poured out. When the pouch is to be reclosed, the top margin is pulled out of the second slot and the margin of the pouch opening is pulled into the first slot just as in the first embodiment described above.

The present invention will be better understood and appreciated from the following detailed description of two embodiments thereof, selected for purposes of illustration and shown in the accompanying drawings.

BRIEF FIGURE DESCRIPTION

DETAILED SPECIFICATION

Figure 1:
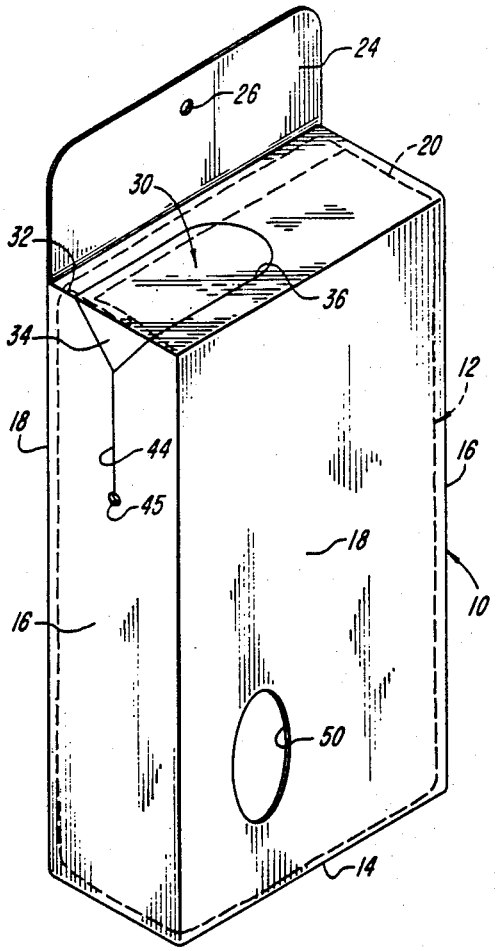
FIG. 1 is a perspective view of a closed box constructed in accordance with this invention.

The package which comprises this invention includes a semi-rigid, box-like outer container 10 made of cardboard, corrugated or similar inexpensive material and a flexible bag-like pouch or liner 12 disposed in the container and typically made of a plastic film or similar material. The pouch material may, of course, be transparent. As suggested above, the packaged material in the box and pouch typically may be seed, feed or the like marketed in the pet industry, or foodstuffs such as cereal, candy or the like intended for human consumption. It is also contemplated that the package may be used for liquids.

The box 10 is shown in the drawings to include a bottom wall 14, opposed pairs of side walls 16 and 18, and a top wall 20. In the embodiment shown, the box also includes a header strip 24 which has a hole 26 in it, that enables the box to be displayed on a rack or stand in the retail establisment where the goods are sold. The header and box, of course, may carry advertising material, identifying copy, or other information relating to the product packaged in it.

A removable tab 30 which extends into a portion of the top wall and one of the side walls 16 and over edge 32 of the box 10 has a V shaped lower end 34 in the side wall. A perforated line 36 which defines the tab enables it to be pulled from the box so as to form an opening 38 through which the container contents may be poured.

Figure 2:
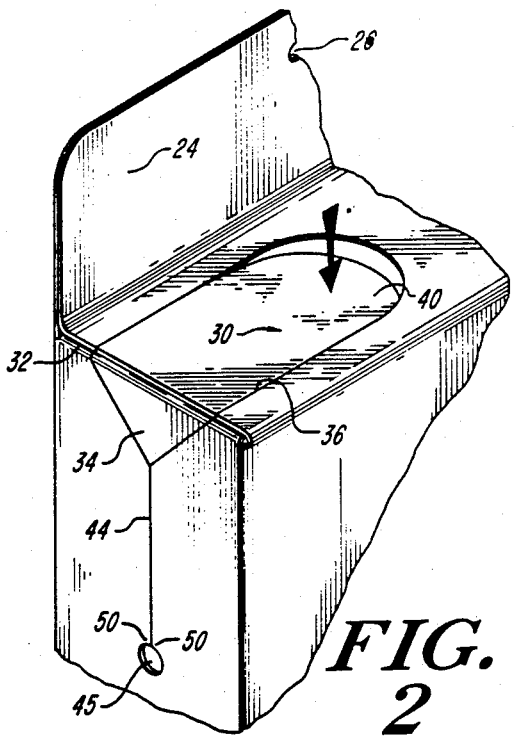
FIG. 2–4 are fragmentary perspective views of a corner of the box of FIG. 1 and showing how the box is opened.
Figure 3:
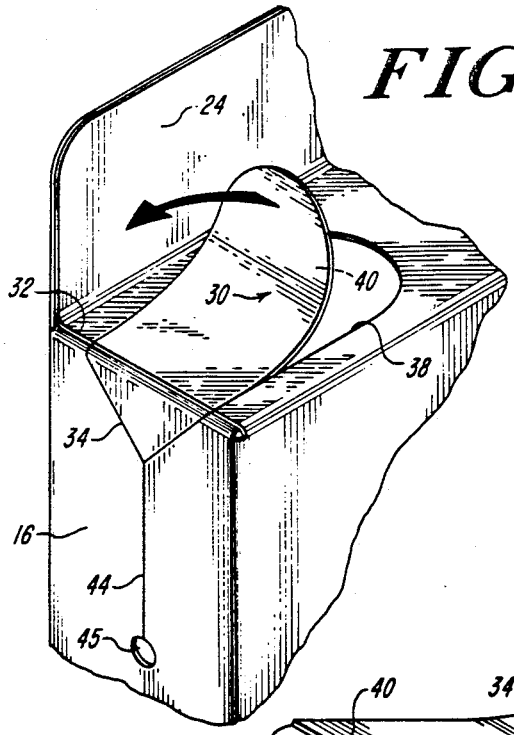
Figure 4:
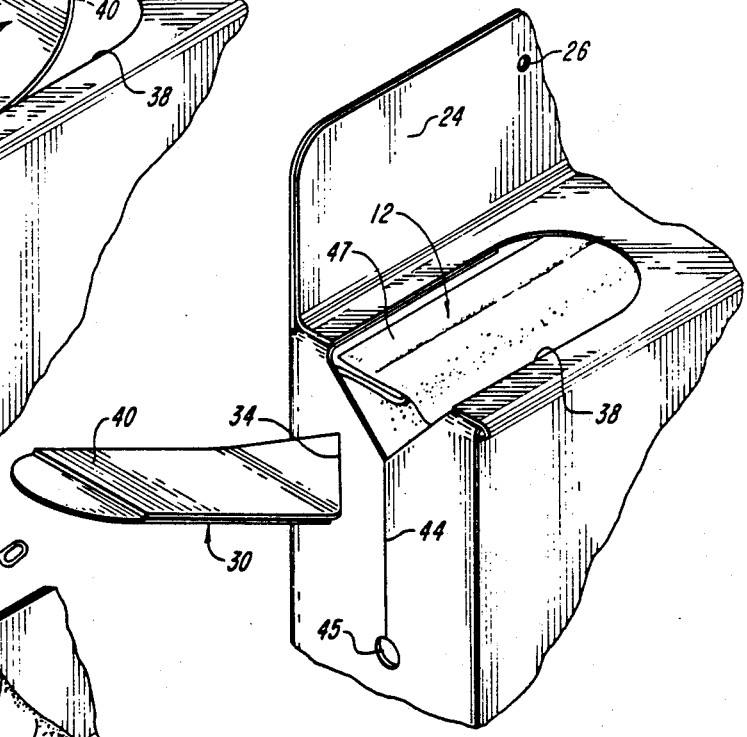

FIG. 2–4 suggest how the top portion 40 of the tab 30 may be pushed into the box so that it may be grasped with the fingers and then be pulled from the box to form the opening 38.

A slot 44 which also may be defined by a perforated line and opened with the fingers is provided in the side wall as a continuation of the portion of the opening 38 formed by the V-shaped part 34 of the tab. The V-shaped part of the opening 38 essentially leads into the slot 44 and assists in guiding the pouch material into it. The slot 44 as is described more fully below forms a closure for the pouch. A small round hole 45 is formed a the lower end to resist tearing of the box beyond the slot when the box is opened. It also serves to retain the margins of the pouch in the slot when it is used to reclose the package as is described more fully below.

Figure 5:
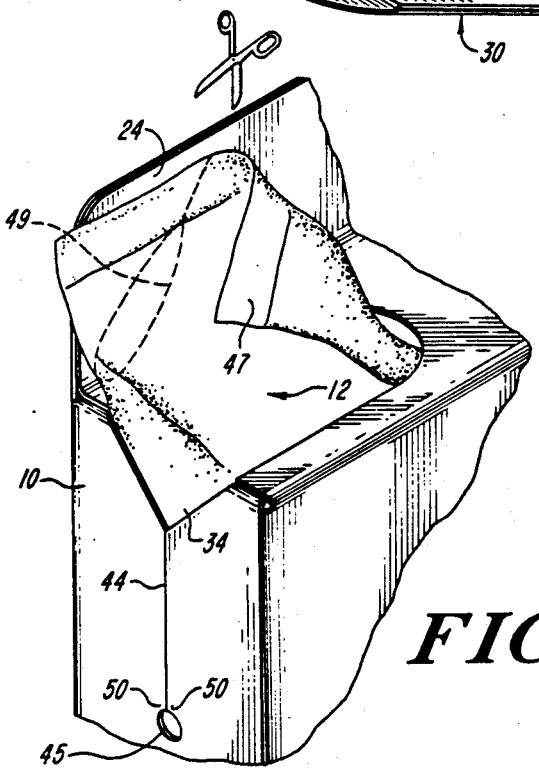
FIG. 5 is a fragmentary perspective view of the same corner of the box and showing how the pouch may be pulled through the open box and cut or torn to open the pouch.

The pouch disposed in the container 10 may be formed from a single sheet of flexible material such as polyethylene, wax paper, or laminated film (it may or may not be an air barrier), and it is seamed by heat sealing or other well-known technique along one side as well as the top and bottom to form a sealed chamber for its contents to maintain its freshness and extend its shelf life. In FIGS. 4 and 5, the pouch 12 is shown provided with a sealed margin 47 at the top.

For certain applications, it is particularly desirable that the liner which forms the pouch be made of a transparent material. In the embodiment shown, a window 50 is provided in the front wall of the box 10 through which the pouch and its contents may be viewed.

Figure 6:
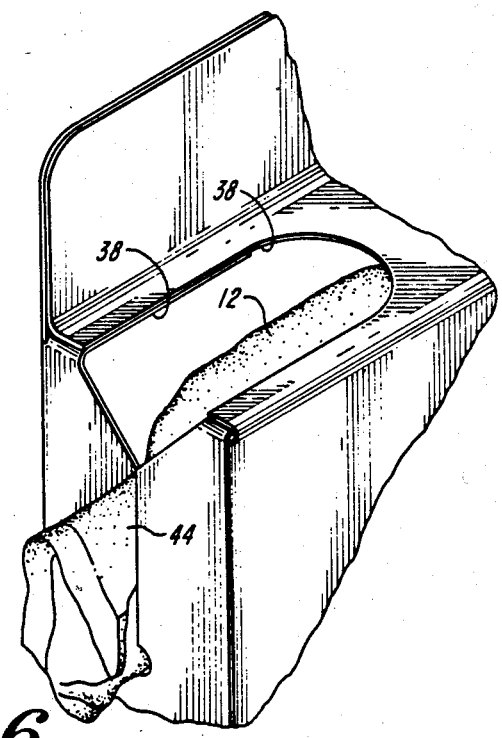
FIG. 6 is a fragmentary perspective view of the corner of the box and showing how the pouch may be reclosed and sealed.

When the package is initially filled in the factory, the liner 12 is sealed and the tab 30 is in place as part of the container top and side walls. (The weakened or perforated line 38 is not torn.) The package is maintained in that condition when it is shipped from the source to its point of sale. When the consumer wishes to open the package, he or she may push down on the tab 30 and tear it off the box as suggested in the goods are sold. The header and box, of course, may carry FIGS. 2–4. With the tab 30 removed, the user can reach into the box 10 through opening 38 and pull upwardly on the corner of the pouch 12 within it so as to draw at least a portion of the margin 47 of it outside the box as is suggested in FIG. 5. The opening 38 is sufficiently large so that the pouch can be easily grasped through the top. The user can then either tear or cut the corner of the pouch to form an opening 49 and then merely pour the contents, or as much thereof as desired, from the pouch while the pouch remains in the box. The large size of the opening 38 also permits the contents to be poured readily through it. To close and seal the pouch, the margin of the hole 49 torn or cut at the corner may simply be drawn into the slot 44 as shown in FIG. 6, which serves as a clamp or closure for the pouch. The lower end of the margin of the pouch should extend into the hole 45. The upper corners 50 of the hole will tend to retain the margin in the slot and prevent it from riding up and out of it. In this simple fashion, the package may be closed and made ready for storage without fear of the contents spilling from it.

Figure 7:
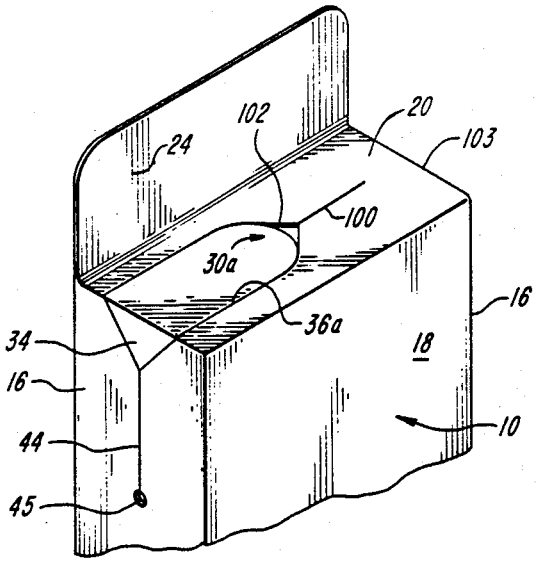
FIG. 7 is a fragmentary perspective view of a box in accordance with a second embodiment of this invention.
Figure 8:
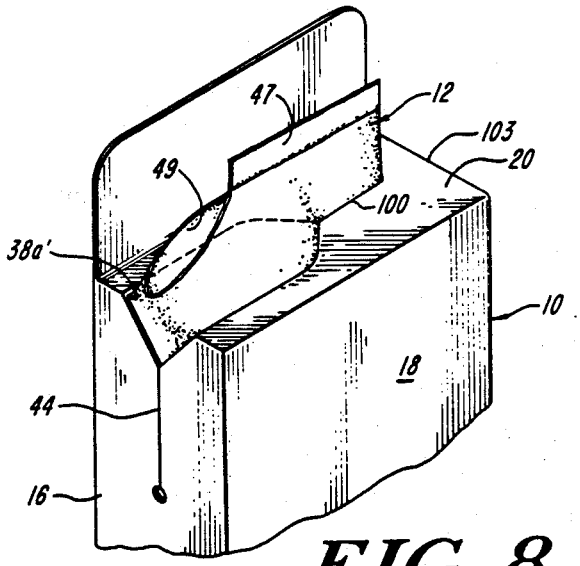
FIG. 8 is a fragmentary perspective view of the box of FIG. 7 and showing how it supports the pouch within when the contents are to be poured from the package.

The second embodiment of this invention shown in FIGS. 7 and 8 includes all features of the embodiment of FIGS. 1–6, and therefore, the description of the common parts of both need not be repeated. The corresponding parts of the two embodiments bear the same reference numbers. As an additional feature, the box of the second embodiment includes a second slot 100 in the top wall 20 extending from the margin of the scored line **36*a* which defines the opening 38*a* and laterally away from the side wall 16 in which the first slot 44 is formed. The slot 100 is formed as a weakened line (perforated or scored) in the box just as the line 36*a* and slot 44 and may be opened by finger pressure on the box material. The portion 102 of the tab 30*a* adjacent the slot 100 is generally V-shaped similar to the V-shaped configuration at 34 above slot 4. That shape serves as a guide to pull the margin 47 of the pouch into the slot 100. Slot 100** provides an added convenience when using the package as is described below.

In FIG. 8 the use for slot 100 is illustrated. In that figure the top margin 47 of the pouch beyond its opening 49 is shown pulled into the slot 100, which serves to hold the pouch in position with its opening 49 aligned with the opening **38*a*. The free end of slot 100 may or may not be provided with a terminating opening similar to opening 45 to further grip the margin 47 and retain it in the slot. That end of the slot 100 may terminate approximately ½ to 1 inch from the adjacent edge 103. Held in this fashion, the user may readily pour from the pouch as much of the contents as desired. When finished the user merely pulls the margin 47 from the slot 100 and pulls the margin of the opening 49 into the slot 44 to seal and close the pouch in precisely the same fashion as described above and illustrated in FIG. 6** in connection with the first embodiment.

From the foregoing description, it will be appreciated that the package of this invention may be made without any significant increase in cost over those packages now used that provide no facility to close and seal the pouch. The tabs and slot of this invention provides the user with a very simple and convenient system for reclosing the package so as to maintain the freshness of the contents and prevent the contents from accidently spilling from the package. The V-shaped portion of the opening 38 guides the pouch material into the slot 44 so that closing the package is an effortless operation. The stiffness of the box material at the margins of the slot 44, which may be enhanced by an extra layer on that side 16, is sufficient to hold the pouch closed.

Those skilled in the art will appreciate that numerous modifications may be made of the invention illustrated in the drawings without departing from the inventive concepts herein disclosed. Therefore, it is not intended that the scope of this invention be limited to the embodiments illustrated and described. Rather, its scope is to be determined by the appended claims and their eguivalents.

What is claimed is:

1. A package particularly intended for use with dry flowable materials comprising a semi-rigid box having a top wall, a bottom wall, and a plurality of side walls, each of said walls being defined by a plurality of edges, said walls being joined together at their edges, a flexible bag-like pouch disposed in the box for holding the flowable material to be packaged, said pouch having a top end openable by cutting or tearing to define a pouring port at the top end when the material is to be removed therefrom, said port being surrounded by margins in the top end, a removable tab closure provided in the top wall and at least one of said side walls of the box and spanning the edges which join them, said tab having a generally V-shaped portion defining an apex, said tab closure being defined by a weakened line which enables the tab to be torn form the box to form an opening in the box through which the packaged material in the pouch may be discharged, and a slot, having first and second ends, defined by a weakened line provided in the top wall or said one side wall of the box, said first slot end extending to the weakened line which defines the tab apex and into which the margins of the top end which surround the pouring port may be drawn to close the port to seal the pouch.

2. A package as defined in claim 1 wherein the V-shaped portion and the slot are in said one side wall of the box.

3. A package as defined in claim 2 wherein the other end of the slot terminates in an enlarged opening.

4. A package as defined in claim 1 wherein a second slot is provided in the top wall for receiving the top end of the pouch so as to hold the pouring port of the pouch in alignment with the opening in the box.

5. A package as defined in claim 4 wherein said second slot extends from the weakened line which defines the tab at a point remote from the first slot, said second slot extending toward a second of said side walls of the box opposite said one side wall which contains the first slot.

6. A package as defined in claim 4 wherein a tab has a second V-shaped portion defining an apex, said apex joining the second slot.

7. A package particularly intended for use with flowable materials comprising a box having a top wall, a bottom wall, and a plurality of side walls, each of said side walls being defined by a plurality of edges, said walls being joined at their edges, a bag-like pouch disposed in the box for containing the flowable material to be packaged, said pouch having a top end openable to define a pouring port at the top end when the material is to be removed therefrom, said pouring port being surrounded by margins in the top end, an opening with a removable closure in one of said walls of the box which may be aligned with the port in the pouch so as to permit pouring of the flowable material of the pouch from the package, said opening having a V-shaped portion defining an apex, and a slot, having first and second ends, provided in said one wall of the box, said first slot end extending to the opening apex and into which the margins of the top end which surround the port may be drawn to seal the pouch closed.

8. A package as defined in claim 7 wherein the pouch is made of a film-like material which may be pulled through the opening and be torn or cut so as to form the port.

9. A package as defined in claim 7 wherein the opening is in one of said side walls.

10. A package as defined in claim 7 wherein the opening is in both the top wall and one of said side walls.

11. A package as defined in claim 10 wherein a slot is in said one side wall containing the opening.

12. A package as defined in claim 11 wherein the closure is a tab which may be torn from the box.

13. A package as defined in claim 12 wherein the tab is defined by a perforated line in the box.

14. A package as defined in claim 7 wherein the said second slot end is enlarged.

* * * * *